US011732546B1

(12) United States Patent
Qiu et al.

(10) Patent No.: US 11,732,546 B1
(45) Date of Patent: Aug. 22, 2023

(54) ULTRA-HIGH EXPANSION DOWNHOLE PACKER

(71) Applicant: Vertechs Oil & Gas Technology Co., Ltd., Chengdu (CN)

(72) Inventors: Chengsong Qiu, Chengdu (CN); Wei Zheng, Chengdu (CN); Wei Zhang, Chengdu (CN); Qijun Zeng, Chengdu (CN)

(73) Assignee: VERTECHS OIL & GAS TECHNOLOGY CO., LTD., Chengdu (CN)

( * ) Notice: Subject to any disclaimer, the term of this patent is extended or adjusted under 35 U.S.C. 154(b) by 0 days.

(21) Appl. No.: 18/071,657

(22) Filed: Nov. 30, 2022

(51) Int. Cl.
*E21B 33/128* (2006.01)
*E21B 33/12* (2006.01)

(52) U.S. Cl.
CPC ..... *E21B 33/128* (2013.01); *E21B 33/1208* (2013.01)

(58) Field of Classification Search
CPC ... E21B 33/128; E21B 33/1208; E21B 33/129
See application file for complete search history.

(56) References Cited

U.S. PATENT DOCUMENTS

| | | | | |
|---|---|---|---|---|
| 7,128,146 | B2 * | 10/2006 | Baugh | E21B 43/105 72/393 |
| 11,428,060 | B1 * | 8/2022 | Murphy | E21B 23/06 |
| 11,434,715 | B2 * | 9/2022 | Harris | E21B 33/1265 |
| 2009/0126925 | A1 * | 5/2009 | Guest | E21B 33/1216 166/118 |
| 2014/0209325 | A1 * | 7/2014 | Dockweiler | E21B 23/01 166/217 |
| 2017/0370176 | A1 * | 12/2017 | Frazier | E21B 33/1291 |
| 2018/0016864 | A1 * | 1/2018 | Parekh | E21B 33/1291 |
| 2019/0352998 | A1 * | 11/2019 | Wolf | E21B 33/128 |
| 2023/0026973 | A1 * | 1/2023 | Milne | E21B 33/128 |

* cited by examiner

*Primary Examiner* — Theodore N Yao
(74) *Attorney, Agent, or Firm* — Bayramoglu Law Offices LLC

(57) ABSTRACT

An ultra-high expansion downhole packer includes an anchor, a primary expansion cone, and a central tube. The anchor is provided with a first tapered through-hole having a large end sleeved at a small end of the primary expansion cone. The anchor is radially expandable to anchor with an inner wall of a wellbore. The primary expansion cone is provided with a second tapered through-hole, and the second tapered through-hole has a large end sleeved at a small end of the central tube. The primary expansion cone is a radially expandable structure, and the primary expansion cone supports the anchor after an expansion. The primary expansion cone is provided between the anchor and the central tube. The primary expansion cone is first driven into the anchor to make the anchor radially expand, and then the central tube is driven into the primary expansion cone to make the anchor radially expand again.

19 Claims, 19 Drawing Sheets

ULTRA-HIGH EXPANSION DOWNHOLE PACKER

TECHNICAL FIELD

The present disclosure relates to the technical field of downhole construction and in particular to an ultra-high expansion downhole packer.

BACKGROUND

In the field of oil and gas development, through-tubing operation and extreme casing deformation treatment require tubing isolation. The operating tool is expected to have a minimum outer diameter and expand to a maximum outer diameter after being lowered into the operation position. This requires an ultra-high expansion packer. However, the expansion ratio of the existing packers cannot meet the requirement of an ultra-high expansion packer to achieve tubing closure operation.

SUMMARY

To solve the above technical problems, the present disclosure provides an ultra-high expansion downhole packer to achieve tubing closure operation.

To solve the above technical problems, the present disclosure provides the following technical solution. The ultra-high expansion downhole packer includes an anchor, a primary expansion cone, and a central tube.

The anchor is provided with a first tapered through-hole, and the first tapered through-hole has a large end sleeved at a small end of the primary expansion cone. The anchor is radially expandable to anchor with an inner wall of a wellbore.

The primary expansion cone is provided with a second tapered through-hole, and the second tapered through-hole has a large end sleeved at a small end of the central tube. The primary expansion cone is a radially expandable structure, and the primary expansion cone supports the anchor after an expansion.

The working principles and benefits of the present disclosure are as follows. The primary expansion cone is provided between the anchor and the central tube. An operating tool first drives the primary expansion cone into the anchor to make the anchor radially expand, and the central tube is moved with the primary expansion cone. After the first radial expansion of the anchor is achieved, the operating tool continues to drive the central tube into the primary expansion cone. The primary expansion cone and the anchor are expanded at the same time until the anchor anchors with the inner wall of the wellbore. Thus, the expansion of the primary expansion cone and the anchor is achieved, and a second radial expansion of the anchor is achieved. The design achieves the ultra-high expansion downhole packer and can provide isolation during extreme casing deformation and through-tubing operation.

The present disclosure may further make the following improvements based on the above technical solution.

Further, the large end of the primary expansion cone is provided with a first anti-pre-expansion section, and the first anti-pre-expansion section has a first initial expansion force greater than the initial expansion force of the anchor.

The above further solution has the following benefits. The large end of the primary expansion cone is provided with the first anti-pre-expansion section. During operation, the operating tool only needs to directly drive the central tube into the anchor. When a radial extrusion force exerted by the primary expansion cone on the anchor is greater than the initial expansion force of the anchor, the anchor is radially expanded, thus achieving the first radial expansion of the anchor. The operating tool continues to drive the central tube into the primary expansion cone. When the radial extrusion force exerted by the central tube on the primary expansion cone is greater than the first initial expansion force, the primary expansion cone drives the anchor to be radially expanded until the anchor anchors with the inner wall of the wellbore. Thus, the expansion of the primary expansion cone and the anchor is achieved, and a second radial expansion of the anchor is achieved.

The present disclosure may further make the following improvements based on the above technical solution.

Further, the primary expansion cone includes a plurality of primary expansion plates that are circumferentially arranged and radially expandable. The plurality of primary expansion plates form an integrated structure at the large end of the primary expansion cone to form the first anti-pre-expansion section.

The above further solution has the following benefits. The large end of the primary expansion cone is formed into an integrated structure to form the first anti-pre-expansion section. Such a structure is simple.

The present disclosure may further make the following improvements based on the above technical solution.

Further, the primary expansion cone includes primary expansion plates that are circumferentially arranged and radially expandable. A first anti-pre-expansion hoop is sleeved on the primary expansion plates at the large end of the primary expansion cone to form the first anti-pre-expansion section.

The above further solution has the following benefits. Through the structural design of the first anti-pre-expansion hoop, the primary expansion cone including a plurality of primary expansion plates forms a universal structure. Therefore, different first anti-pre-expansion hoops can be used to adapt different first initial expansion forces.

The present disclosure may further make the following improvements based on the above technical solution.

Further, the downhole packer includes a sealing element, and the sealing element is radially expandable to create a seal with the inner wall of the wellbore. The sealing element is located at the large end of the first tapered through-hole and sleeved at the small end of the primary expansion cone. The primary expansion cone supports the sealing element after the expansion.

The above further solution has the following benefits. Through the sealing element, the downhole packer further improves the sealing effect on the wellbore.

The present disclosure may further make the following improvements based on the above technical solution.

Further, the sealing element and the anchor form an integrated structure.

The above further solution has the following benefits. The integrated structure is simple and achieves both anchoring and sealing.

The present disclosure may further make the following improvements based on the above technical solution.

Further, the downhole packer includes a sealing element, and the sealing element is radially expandable to create a seal with the inner wall of the wellbore. The sealing element is a sealing ring sleeved in a circumferential direction of the anchor.

The above further solution has the following benefits. The sealing ring is expanded together with the anchor to form a seal with the inner wall of the wellbore. The sealing ring has reliable sealing performance. In addition, different specifications of sealing rings can be used to satisfy the sealing requirements under different operating conditions.

The present disclosure may further make the following improvements based on the above technical solution.

Further, the primary expansion cone includes a plurality of primary expansion plates that are circumferentially arranged and radially expandable. The primary expansion cone has a primary spiral expansion section of a certain length. The primary spiral expansion section is formed by the spiral splicing of the primary expansion plates and maintains a spirally spliced structure after a radial expansion.

The above further solution has the following benefits. The primary spiral expansion section maintains a spirally spliced structure after a radial expansion and plays a support role in the circumferential direction. Meanwhile, the primary expansion cone with the spiral structure also has the role of preventing pre-expansion, thus further improving the anti-pre-expansion effect.

The present disclosure may further make the following improvements based on the above technical solution.

Further, after the primary expansion cone is driven into the anchor, the primary spiral expansion section is radially expanded to support at least part of the anchor.

The above further solution has the following benefits. The design ensures the overall support of the primary expansion cone for the anchor in the radial direction.

The present disclosure may further make the following improvements based on the above technical solution.

Further, the anchor includes a plurality of toothed plates arranged circumferentially. The primary expansion cone includes a plurality of primary expansion plates that are circumferentially arranged and radially expandable. The primary expansion plates are in one-to-one correspondence to the toothed plates. A primary limiting structure is provided between the outer surface of each of the primary expansion plates and the inner surface of each of the toothed plates to prevent relative circumferential movement between each of the primary expansion plates and each of the toothed plates.

The above further solution has the following benefits. The primary limiting structure is provided between the outer surface of each of the primary expansion plates and the inner surface of each of the toothed plates to prevent relative circumferential movement between each of the primary expansion plates and each of the toothed plates. In this way, the primary expansion plates always support the anchor during the expansion.

The present disclosure may further make the following improvements based on the above technical solution.

Further, the primary limiting structure is a first nested limiting structure provided between the outer surface of each of the primary expansion plates and the inner surface of each of the toothed plates.

The above further solution has the following benefits. The first nested limiting structure is simple and reliable.

The present disclosure may further make the following improvements based on the above technical solution.

Further, the end of the anchor far from the primary expansion cone is butted with a lower sub.

The above further solution has the following benefits. The lower sub can be connected directly to the operating tool.

The present disclosure may further make the following improvements based on the above technical solution.

Further, a secondary expansion cone is provided between the primary expansion cone and the central tube. The secondary expansion cone is provided with a third tapered through-hole, and the third tapered through-hole has a large end sleeved at the small end of the central tube. The secondary expansion cone is a radially expandable structure, and the secondary expansion cone supports the primary expansion cone after the expansion.

The above further solution has the following benefits. The secondary expansion cone is combined with the primary expansion cone and the central tube to achieve three radial expansions of the downhole packer, thus further improving the expansion capabilities of the downhole packer.

The present disclosure may further make the following improvements based on the above technical solution.

Further, the large end of the primary expansion cone is provided with a first anti-pre-expansion section, and the first anti-pre-expansion section has a first initial expansion force greater than the initial expansion force of the anchor. The large end of the secondary expansion cone is provided with a second anti-pre-expansion section, and the second anti-pre-expansion section has a second initial expansion force greater than the first initial expansion force of the first anti-pre-expansion section.

The above further solution has the following benefits. The second initial expansion force is greater than the first initial expansion force. During operation, the operating tool only needs to directly drive the central tube into the anchor. When a radial extrusion force exerted by the primary expansion cone on the anchor is greater than the initial expansion force of the anchor, the anchor is radially expanded, thus achieving the first radial expansion of the anchor. The operating tool continues to drive the secondary expansion cone into the primary expansion cone. When the radial extrusion force exerted by the secondary expansion cone on the primary expansion cone is greater than the first initial expansion force, the primary expansion cone is radially expanded, and the second radial expansion of the anchor is achieved. The operating tool continues to drive the central tube into the secondary expansion cone. When the radial extrusion force exerted by the central tube on the secondary expansion cone is greater than the second initial expansion force, the secondary expansion cone is radially expanded until the anchor anchors with the inner wall of the wellbore. Thus, the expansion of the secondary expansion cone is achieved, and a third radial expansion of the anchor is achieved.

The present disclosure may further make the following improvements based on the above technical solution.

Further, the secondary expansion cone includes a plurality of secondary expansion plates that are radially expandable. The plurality of secondary expansion plates form an integrated structure at the large end of the secondary expansion cone to form the second anti-pre-expansion section.

The above further solution has the following benefits. The large end of the secondary expansion cone is formed into an integrated structure to form the second anti-pre-expansion section. Such a structure is simple.

The present disclosure may further make the following improvements based on the above technical solution.

Further, the secondary expansion cone includes a plurality of secondary expansion plates that are radially expandable. A second anti-pre-expansion hoop is sleeved on the secondary expansion plates at the large end of the secondary expansion cone to form the second anti-pre-expansion section.

The above further solution has the following benefits. Through the structural design of the second anti-pre-expansion hoop, the secondary expansion cone including a plurality of secondary expansion plates forms a universal structure. Therefore, different second anti-pre-expansion hoops can be used to adapt different second initial expansion forces.

The present disclosure may further make the following improvements based on the above technical solution.

Further, the secondary expansion cone includes a plurality of secondary expansion plates that are circumferentially arranged and radially expandable. The secondary expansion cone has a secondary spiral expansion section of a certain length. The secondary spiral expansion section is formed by the spiral splicing of the secondary expansion plates and maintains a spirally spliced structure after a radial expansion.

The above further solution has the following benefits. The secondary spiral expansion section maintains a spirally spliced structure after a radial expansion and plays a support role in the circumferential direction. Meanwhile, the secondary expansion cone with the spiral structure also has the role of preventing pre-expansion, thus further improving the anti-pre-expansion effect.

The present disclosure may further make the following improvements based on the above technical solution.

Further, after the secondary expansion cone is driven into the primary expansion cone, the secondary spiral expansion section is radially expanded to support at least part of the primary expansion cone.

The above further solution has the following benefits. The design ensures the overall support of the secondary expansion cone for the primary expansion cone in the radial direction.

The present disclosure may further make the following improvements based on the above technical solution.

Further, the primary expansion cone includes a plurality of primary expansion plates that are circumferentially arranged and radially expandable. The secondary expansion cone includes a plurality of secondary expansion plates that are circumferentially arranged and radially expandable. The primary expansion plates are in one-to-one correspondence to the secondary expansion plates. A secondary limiting structure is provided between the outer surface of each of the secondary expansion plates and an inner surface of each of the primary expansion plates to prevent relative circumferential movement between each of the secondary expansion plates and each of the primary expansion plates.

The above further solution has the following benefits. The secondary limiting structure is provided between the outer surface of each of the secondary expansion plates and the inner surface of each of the primary expansion plates to prevent relative circumferential movement between each of the secondary expansion plates and each of the primary expansion plates. In this way, the secondary expansion plates always support the primary expansion plates during the expansion.

The present disclosure may further make the following improvements based on the above technical solution.

Further, the secondary limiting structure is a second nested limiting structure provided between the outer surface of each of the secondary expansion plates and the inner surface of each of the primary expansion plates.

The above further solution has the following benefits. The second nested limiting structure is simple and reliable.

REFERENCE NUMERALS

Figure 1:
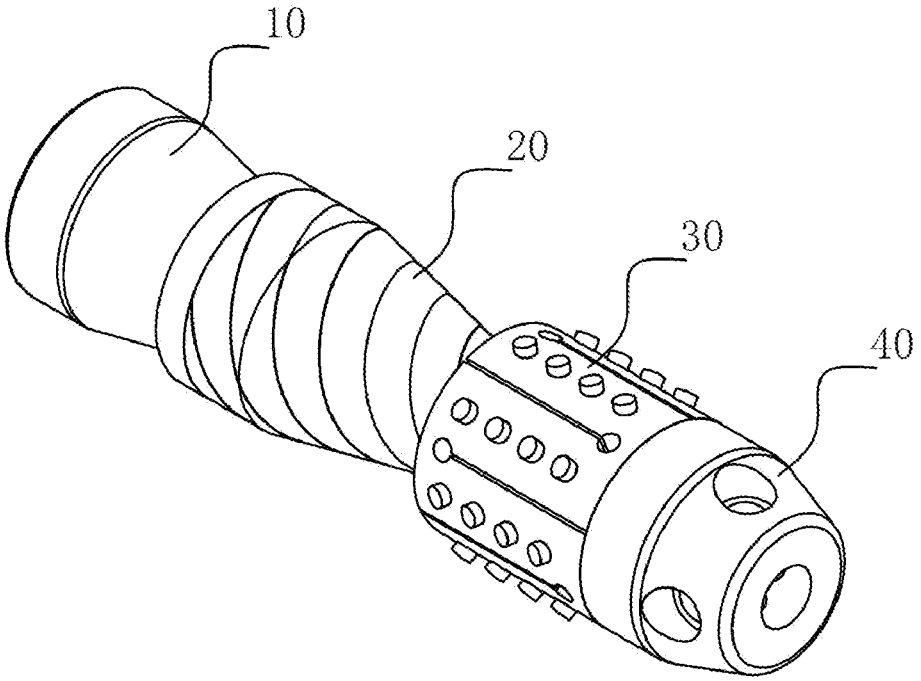
FIG. 1 is a stereoscopic view of a downhole packer according to a second embodiment of the present disclosure.
Figure 2:
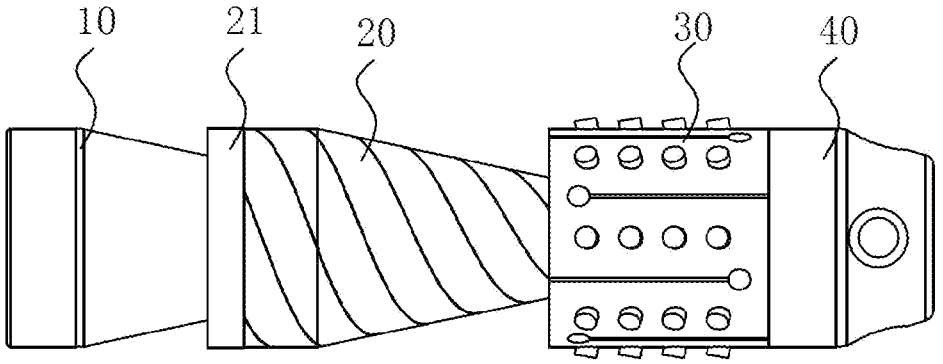
FIG. 2 is a unidirectional view of the downhole packer according to the second embodiment of the present disclosure.
Figure 3:
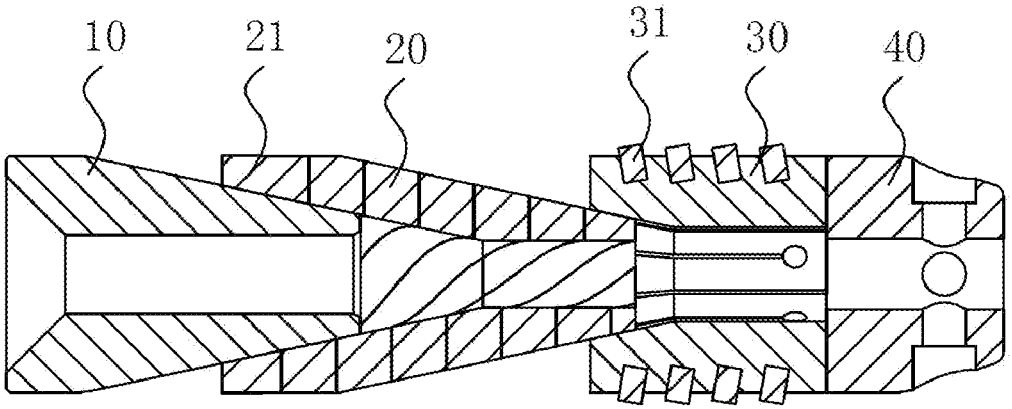
FIG. 3 is a unidirectional section view of the downhole packer shown in FIG. 2.

10. central tube; 20. primary expansion cone; 21. first anti-pre-expansion section; 30. anchor; 31. slip tooth; 40. lower sub; 50. secondary expansion cone; 51. second anti-pre-expansion section; 60. sealing element; 71. recess; and 72. projection.

DETAILED DESCRIPTION OF THE EMBODIMENTS

The principles and features of the present disclosure are described below in combination with the accompanying drawings. The listed embodiments are only used to explain the present disclosure, rather than to limit the scope of the present disclosure. In this embodiment, a unidirectional sectional view refers to one formed by projecting a center-line position in the figure downward.

The present disclosure provides an ultra-high expansion downhole packer. In a first embodiment of the present disclosure, the downhole packer includes an anchor, a primary expansion cone, and a central tube. The anchor is provided with a first tapered through-hole, and the first tapered through-hole has a large end sleeved at a small end of the primary expansion cone. The anchor is radially expandable to anchor with an inner wall of a wellbore. The primary expansion cone is provided with a second tapered through-hole, and the second tapered through-hole has a large end sleeved at a small end of the central tube. The primary expansion cone is a radially expandable structure, and the primary expansion cone supports the anchor after an expansion.

The anchor is a slip, including a slip body and slip teeth. The slip body has a plurality of toothed plates, which are connected end to end to form a hinged slip. The slip is made of a high-ductility material. When the slip is radially expanded, the connections of the slip will not break, which ensures that the slip is formed as an integrated structure and avoids the toothed plate breaking and falling off during the radial expansion of the slip.

Specifically, in this embodiment, an operating tool is assembled with the packer. The operating tool has one end butted with the slip and the other end butted with the central tube and the primary expansion cone. The operating tool and the packer are put into a downhole predetermined zone. The operating tool can be started to exert a thrust on the central tube and the primary expansion cone at one end and provide support for the slip at the other end. The operating tool drives the primary expansion cone into the anchor, and the central tube is moved with the primary expansion cone. The primary expansion cone generates a thrust in the radial direction of the slip, which makes the slip expand in the radial direction. When the primary expansion cone is butted with one end of the operating tool, the primary expansion cone and the slip will not move relative to each other. At this time, the operating tool no longer exerts the thrust on the primary expansion cone, and a first expansion of the slip is achieved.

The operating tool continues to exert a thrust on the central tube, which drives the central tube into the primary expansion cone. The central tube generates a thrust in the radial direction of the primary expansion cone, which causes the primary expansion cone and the slip to be expanded at the same time until the slip anchors with the inner wall of the wellbore. Thus, the expansion of the primary expansion cone and the slip is achieved, and a second radial expansion of the slip is achieved. The achieved expansion ratio is twice that of the existing packer.

Referring to FIGS. 1 to 7, in a second embodiment of the present disclosure, the ultra-high expansion downhole packer includes anchor 30, primary expansion cone 20, and central tube 10. In this embodiment, the anchor 30 is a slip. The slip is provided with a first tapered through-hole, and the first tapered through-hole has a large end sleeved at a small end of the primary expansion cone 20 (that is, the right end of the primary expansion cone 20 in the figure). The slip is radially expandable to anchor with an inner wall of a wellbore. The primary expansion cone 20 is provided with a second tapered through-hole, and the second tapered through-hole has a large end sleeved at a small end of the central tube 10. The primary expansion cone 20 is a radially expandable structure, which supports the slip after an expansion.

A large end of the primary expansion cone 20 is provided with first anti-pre-expansion section 21. The first initial expansion force of the first anti-pre-expansion section 21 is greater than the initial expansion force of the slip. When the slip undergoes a radial expansion and plastic deformation, the initial expansion force for anchoring is equivalent to a minimum axial thrust of the operating tool on the central tube. When the first anti-pre-expansion section 21 undergoes a radial expansion and plastic deformation, the first initial expansion force is equivalent to a minimum axial thrust of the operating tool on the central tube. The slip can have many forms. For example, in this embodiment, a plurality of toothed plates are connected end to end to form a hinged slip, where the plastic deformation of the slip occurs at the connections of the toothed plates.

In this embodiment, the primary expansion cone 20 includes a plurality of primary expansion plates that are circumferentially arranged and radially expandable. The plurality of primary expansion plates form an integrated structure at the large end of the primary expansion cone 20 to form the first anti-pre-expansion section 21. The primary expansion cone 20 has a primary spiral expansion section of a certain length. The primary spiral expansion section is formed by the spiral splicing of primary expansion plates and maintains a spirally spliced structure after a radial expansion. The left end of the primary expansion cone 20 is an integrated structure. That is, spiral split lines between the plurality of primary expansion plates do not penetrate the left end of the primary expansion cone 20. In addition to the first anti-pre-expansion section 21, other parts of the primary expansion cone 20 constitute a primary spiral expansion section. In other words, the primary expansion plates are spirally spliced to form the primary spiral expansion section.

In this embodiment, the end of the anchor 30 far from the primary expansion cone 20 is butted with lower sub 40, which has an inner hole that is connected to the operating tool.

Figure 4:
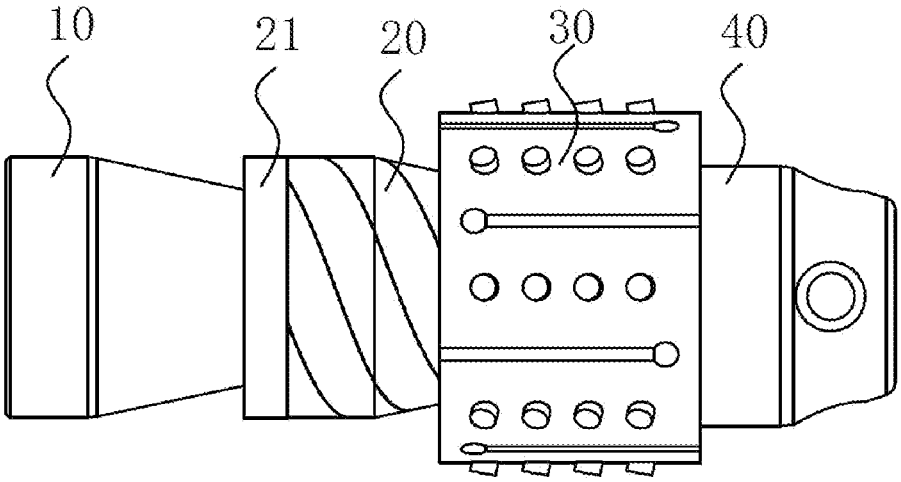
FIG. 4 is a unidirectional view of the downhole packer in the first state according to the second embodiment.
Figure 5:
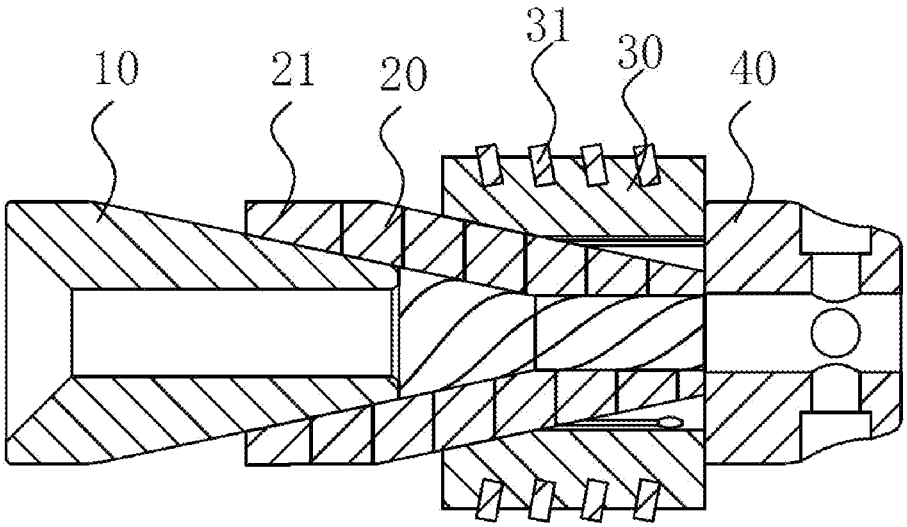
FIG. 5 is a unidirectional section view of the downhole packer shown in FIG. 4.

In this embodiment, one end of the operating tool is fixedly connected to the inner hole of the lower sub, and the other end of the operating tool is butted with the central tube 10. When the operating tool is working, the other end of the operating tool exerts a thrust on the central tube 10, and the one end of the operating tool provides a support force on the lower sub 40, such that the central tube 10 drives the primary expansion cone 20 to move towards the inside of the slip. When an axial thrust exerted by the primary expansion cone 20 on the slip is greater than the initial expansion force of the slip, the slip undergoes plastic deformation and expansion in the radial direction, thus achieving a first radial expansion of the slip (FIGS. 4 and 5). Since the first initial expansion force of the first anti-pre-expansion section 21 is greater than the initial expansion force of the slip, the primary expansion cone 20 is not expanded.

Figure 6:
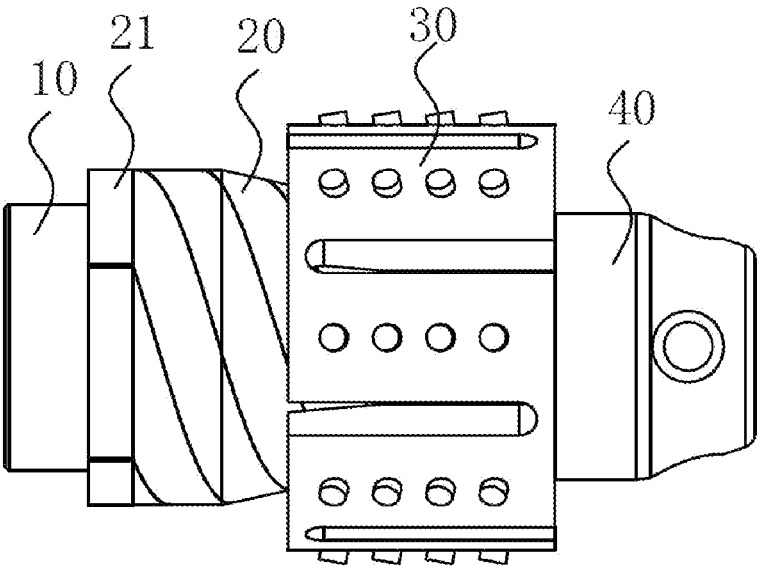
FIG. 6 is a unidirectional view of the downhole packer in a second state according to the second embodiment.
Figure 7:
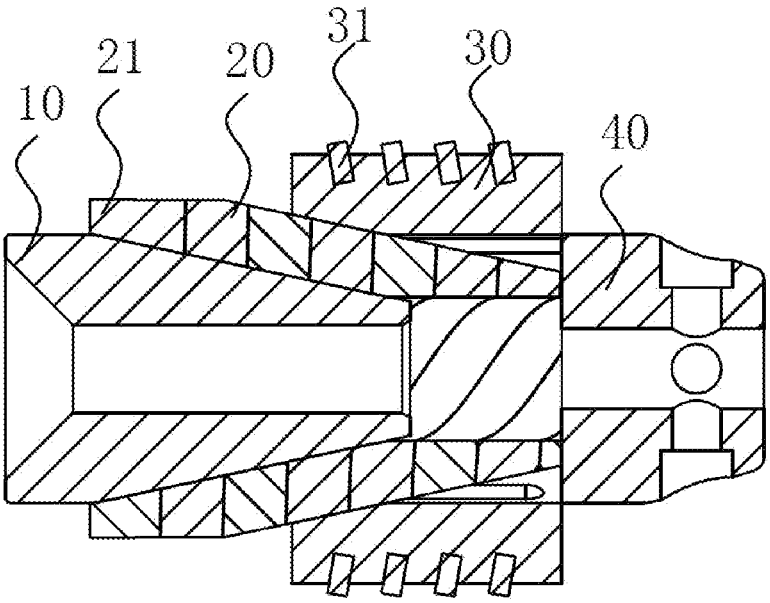
FIG. 7 is a unidirectional section view of the downhole packer shown in FIG. 6.
Figure 8:
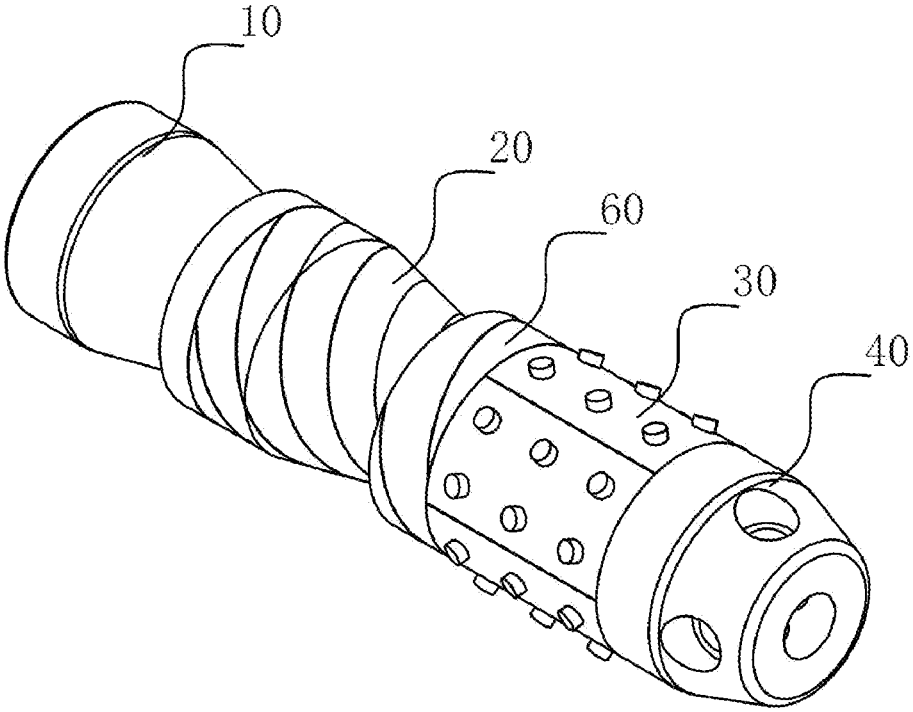
FIG. 8 is a stereoscopic view of a downhole packer according to a third embodiment of the present disclosure.
Figure 9:
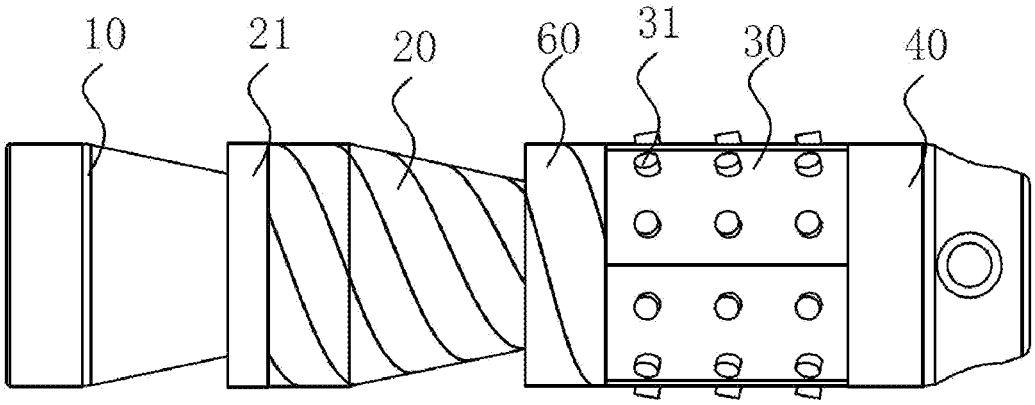
FIG. 9 is a unidirectional view of the downhole packer according to the third embodiment of the present disclosure.
Figure 10:
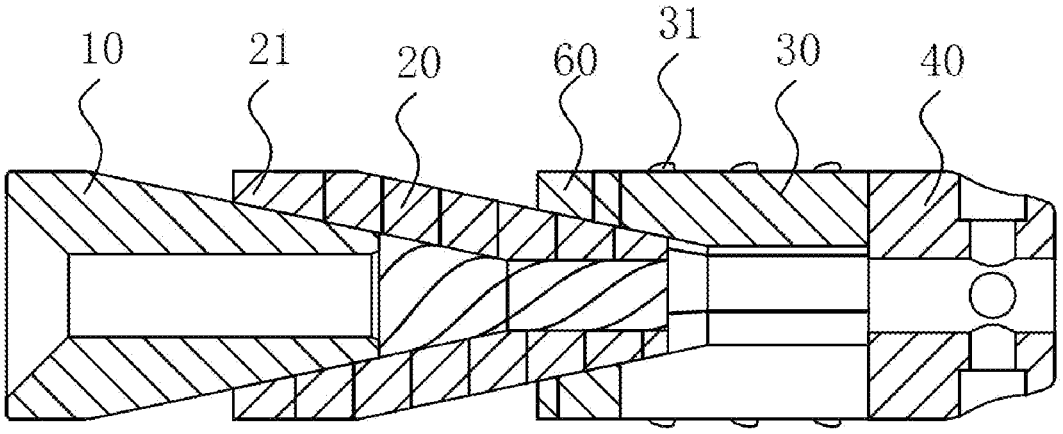
FIG. 10 is a unidirectional section view of the downhole packer shown in FIG. 9.
Figure 11:
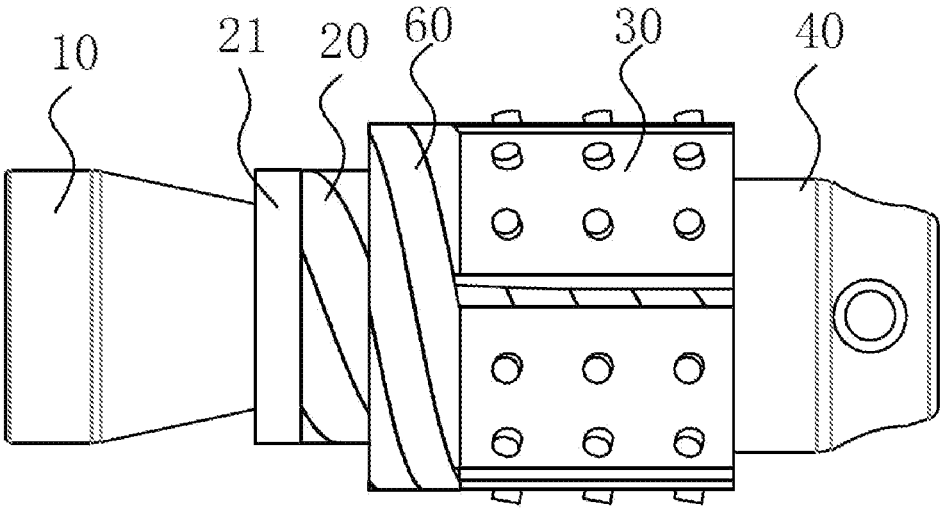
FIG. 11 is a unidirectional view of the downhole packer in the first state according to the third embodiment.
Figure 12:
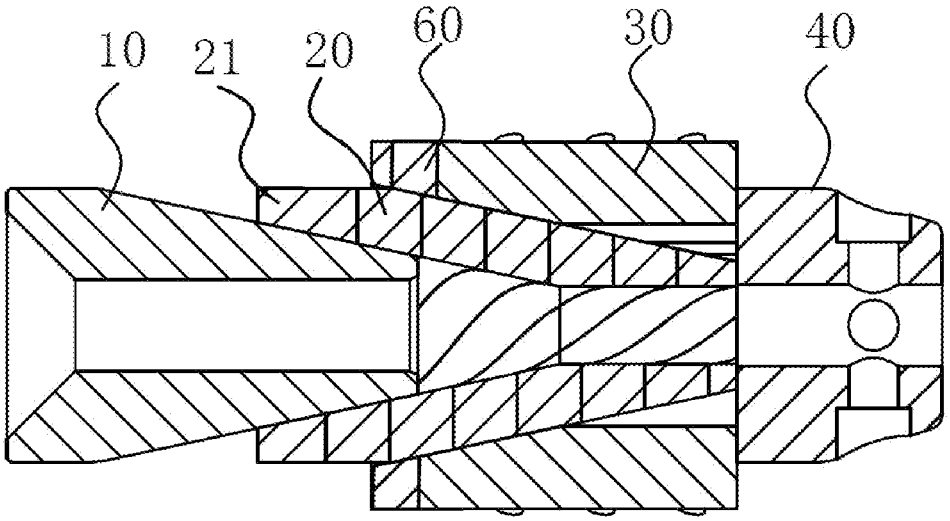
FIG. 12 is a unidirectional section view of the downhole packer shown in FIG. 11.
Figure 13:
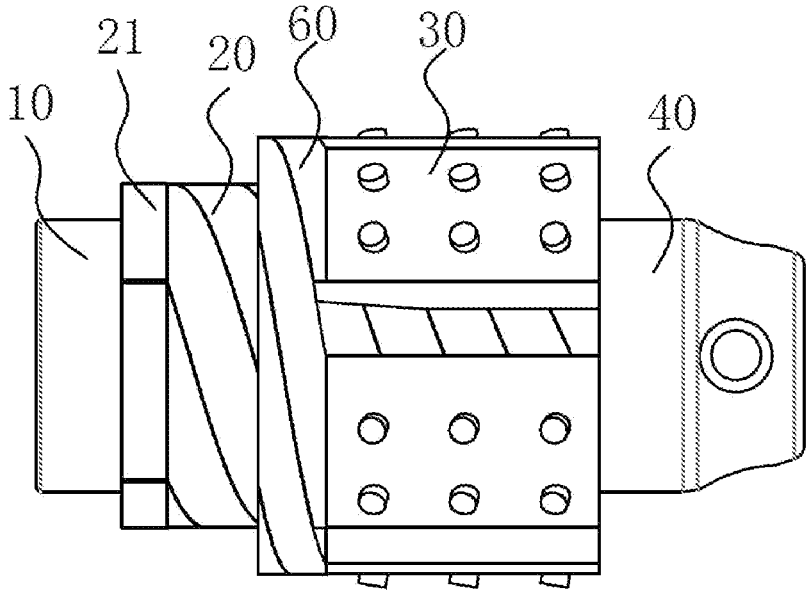
FIG. 13 is a unidirectional view of the downhole packer in a second state according to the third embodiment.
Figure 14:
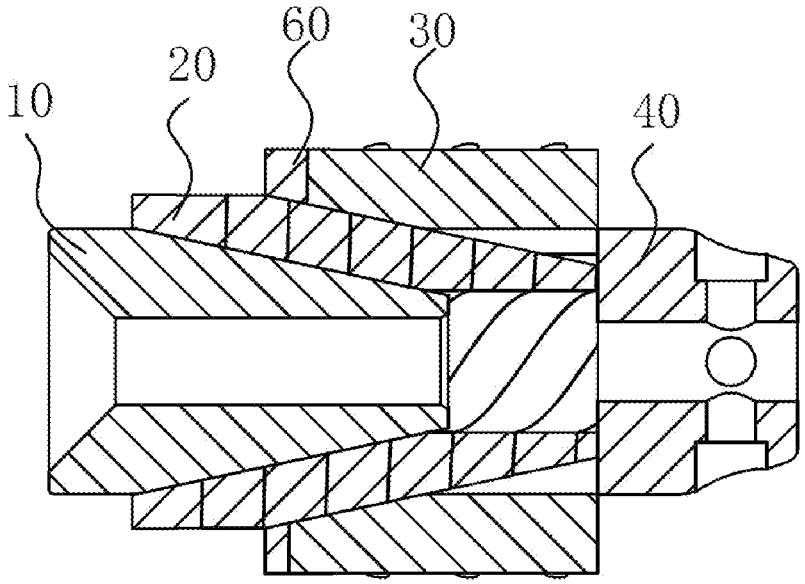
FIG. 14 is a unidirectional section view of the downhole packer shown in FIG. 14.
Figure 15:
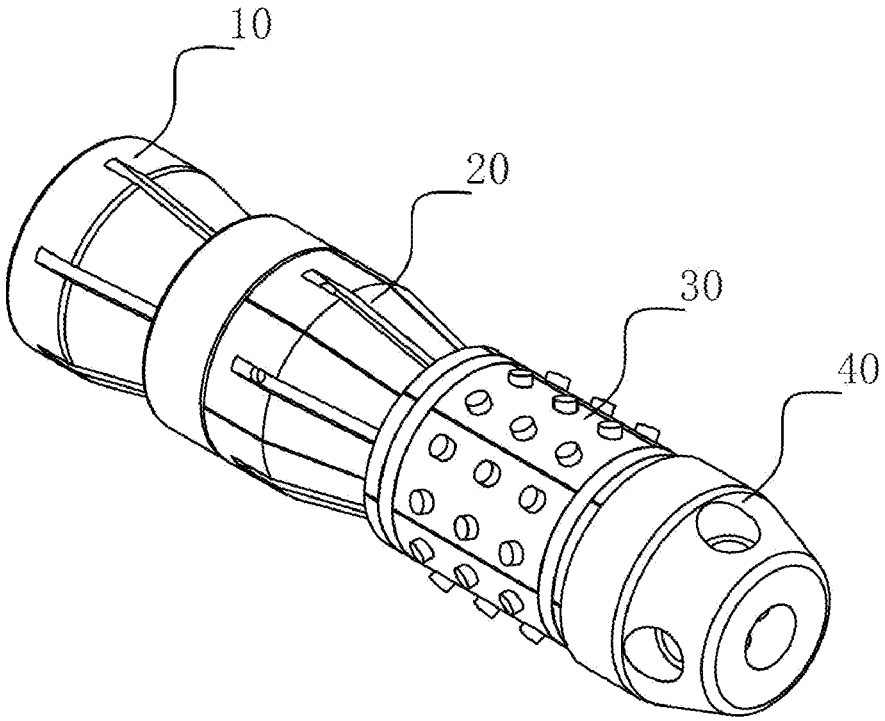
FIG. 15 is a stereoscopic view of a downhole packer according to a fourth embodiment of the present disclosure.
Figure 16:
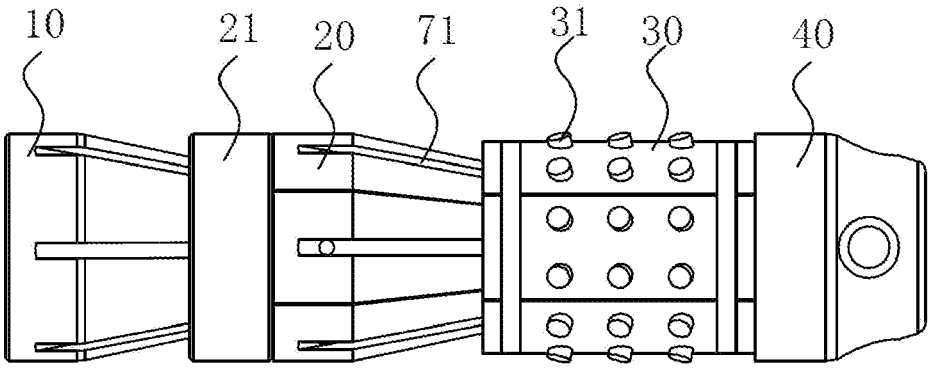
FIG. 16 is a unidirectional view of the downhole packer according to the fourth embodiment of the present disclosure.
Figure 17:
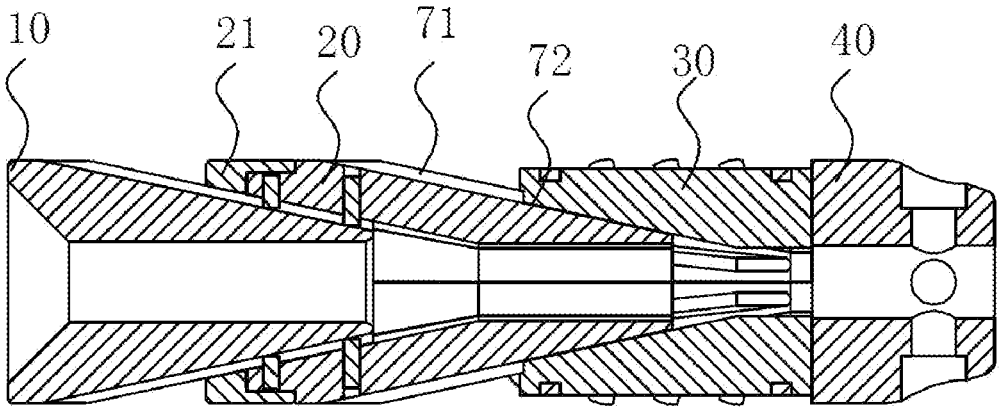
FIG. 17 is a unidirectional section view of the downhole packer shown in FIG. 16.
Figure 18:
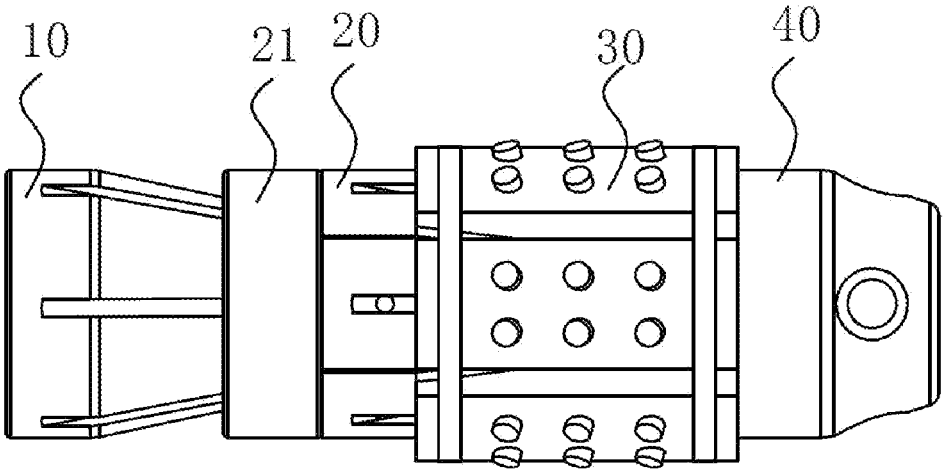
FIG. 18 is a unidirectional view of the downhole packer in the first state according to the fourth embodiment.
Figure 19:
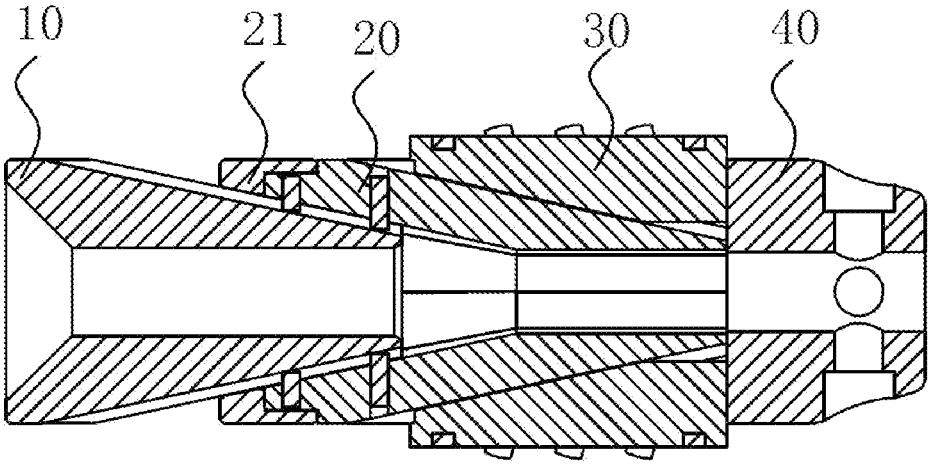
FIG. 19 is a unidirectional section view of the downhole packer shown in FIG. 18.

The operating tool continues to drive the central tube 10 into the primary expansion cone 20. When a radial extrusion force exerted by the central tube 10 on the primary expansion cone 20 is greater than the first initial expansion force, the primary expansion cone 20 is radially expanded until the slip anchors with the inner wall of the wellbore. Thus, a second radial expansion of the slip is achieved through the central tube 10 (FIGS. 6 and 7).

In this embodiment, the expansion ratio of the slip of the downhole packer can reach more than 80%, far exceeding the expansion ratio, namely, 10% to 30%, of the existing packer. Meanwhile, through the expansion of the primary expansion cone 20 and the extrusion of the central tube 10, the slip achieves the sealing function with the inner wall of the wellbore.

Referring to FIGS. 8 to 14, compared with the second embodiment, in a third embodiment of the present disclosure, the downhole packer further includes sealing element 60. The sealing element 60 is radially expandable to create a seal with the inner wall of the wellbore. The sealing element 60 is located at the large end of the first tapered through-hole and sleeved at the small end of the primary expansion cone 20. The primary expansion cone 20 supports the sealing element 60 after an expansion. The sealing element 60 and the anchor 30 form an integrated structure. The anchor 30 is a split slip formed by a plurality of toothed plates arranged circumferentially. The split slip and the sealing element 60 are connected into an integrated structure. In this embodiment, the sealing element 60 is a spiral sealing element 60. The spiral sealing element 60 has a high radial expansion ratio, which ensures the ultra-high expansion ratio of the packer.

The working principle of this embodiment is the same as that of the second embodiment. That is, the first radial expansion (FIGS. 11 and 12) and the second radial expansion (FIGS. 13 and 14) of the slip and the sealing element 60 as a whole are achieved through the operating tool. The design further improves the sealing effect of the packer.

Referring to FIGS. 15 to 21, in a fourth embodiment of the present disclosure, the primary expansion cone 20 includes a plurality of primary expansion plates that are circumferentially arranged and radially expandable. The plurality of primary expansion plates are extended axially and arranged in parallel. A first anti-pre-expansion hoop is sleeved on the primary expansion plates at the large end of the primary expansion cone 20 to form the first anti-pre-expansion section 21. The anchor 30 is an independent split slip, including a plurality of toothed plates. Two ends of the slip are respectively provided with restraint rings. The restraint rings are made of a highly ductile material, which is intended to prevent the toothed plates from being separated after the slip is radially expanded. The primary expansion plates are in one-to-one correspondence to the toothed plates. A primary limiting structure is provided between the outer surface of each of the primary expansion plates and the inner surface of each of the toothed plates to prevent relative circumferential movement between each of the primary expansion plates and each of the toothed plates. The primary limiting structure is a first nested limiting structure provided between the outer surface of each of the primary expansion plates and the inner surface of each of the toothed plates. In this embodiment, the first nested limiting structure includes primary expansion cone recess 71 provided on the outer surface of the primary expansion plate and projection 72 provided on the inner surface of the toothed plate. When the primary expansion cone and the slip are pre-installed, the projection 72 is partially embedded into the primary expansion cone recess 71.

In a specific embodiment, the projection may be provided on the outer surface of the primary expansion plate, and the recess may be provided on the inner surface of the toothed plate. Alternatively, a pin structure protruding from the inner surface of the toothed plate may be provided on the toothed plate, and a recess corresponding to the pin structure may be provided on the outer side of the primary expansion cone 10. In this embodiment, a limiting structure is also provided between the central tube 10 and the primary expansion cone 20 to prevent relative circumferential movement between the central tube and the primary expansion cone. That is, the pin structure protruding from the inner surface of the primary expansion plate is provided on the primary expansion plate, and the recess corresponding to the pin structure is provided on the outer side of the central tube 10.

The working principle is as follows. When the operating tool is in operation, one end of the operating tool drives the lower sub 40 to exert a thrust on the slip, and the other end of the operating tool exerts a thrust on the central tube 10, such that the central tube 10 drives the primary expansion cone 20 to move into the slip. The projection 72 of the slip is moved in a limited way in the primary expansion cone recess 71, so there is no circumferential movement between the primary expansion plate and the slip. When the radial extrusion force exerted by the primary expansion cone 20 on the slip is greater than the initial expansion force of the slip, the slip is radially expanded, thus achieving a first radial expansion of the slip. Since the first initial expansion force of the first anti-pre-expansion section 21 is greater than the initial expansion force of the slip and the radial extrusion force exerted by the central tube 10 on the primary expansion cone 20 is less than the first initial expansion force, the primary expansion cone 20 is not expanded.

Figure 20:
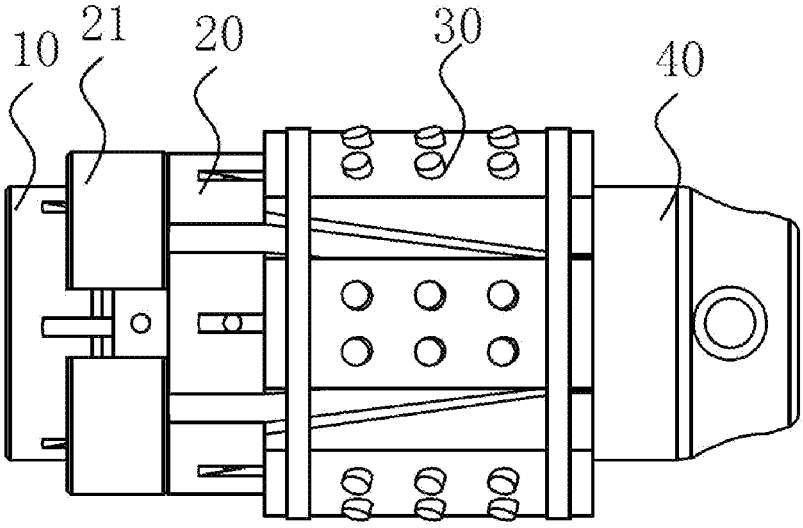
FIG. 20 is a unidirectional view of the downhole packer in a second state according to the fourth embodiment.
Figure 21:
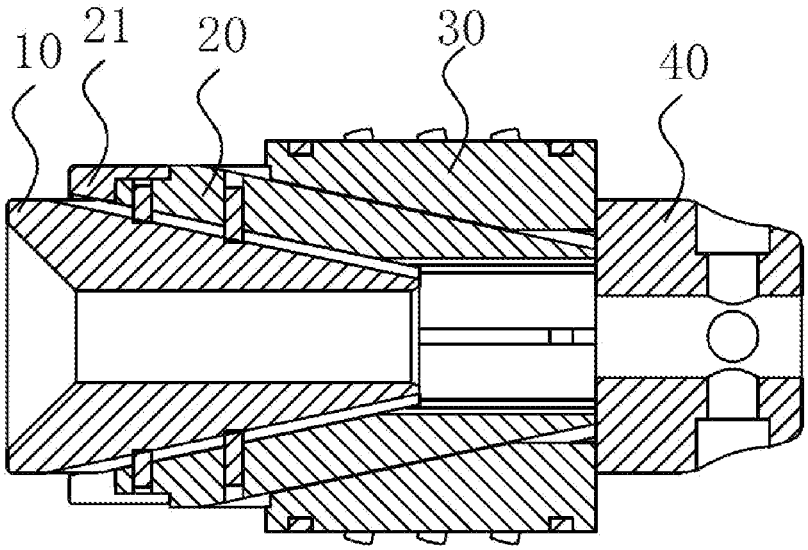
FIG. 21 is a unidirectional section view of the downhole packer shown in FIG. 20.
Figure 22:
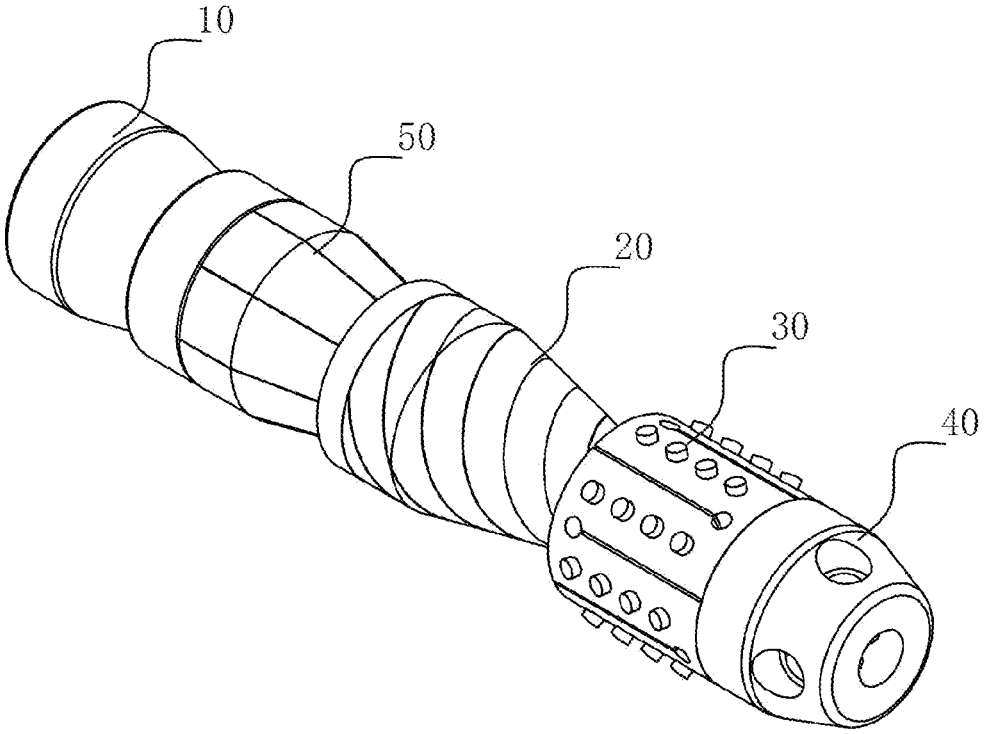
FIG. 22 is a stereoscopic view of a downhole packer according to a fifth embodiment of the present disclosure.
Figure 23:
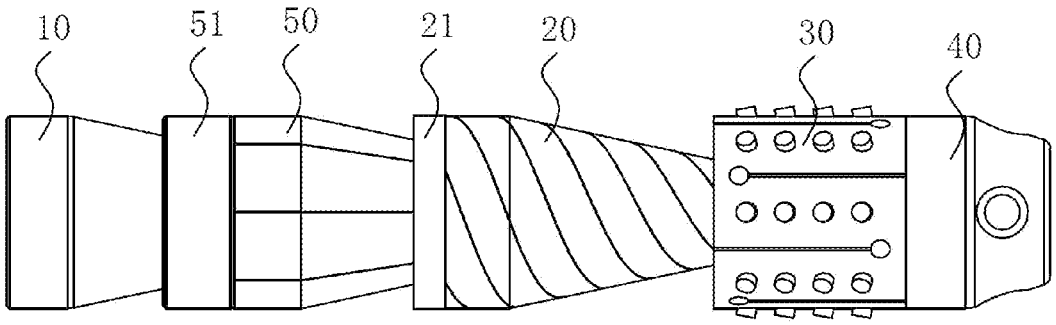
FIG. 23 is a unidirectional view of the downhole packer according to the fifth embodiment of the present disclosure.
Figure 24:
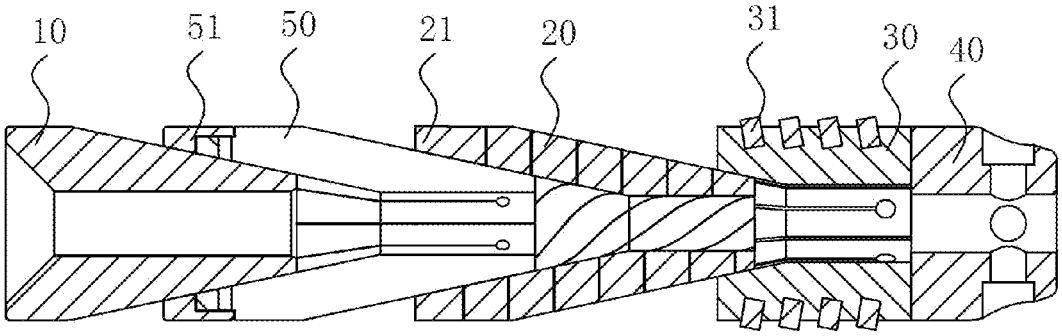
FIG. 24 is a unidirectional section view of the downhole packer shown in FIG. 23.

The operating tool continues to drive the central tube 10 into the primary expansion cone 20. When the radial extrusion force exerted by the central tube 10 on the primary expansion cone 20 is greater than the first initial expansion force, the first anti-pre-expansion hoop of the first anti-pre-expansion section 21 is broken. The primary expansion cone 20 is radially expanded until the slip anchors with the inner wall of the wellbore. Thus, a second radial expansion of the slip is achieved through the central tube 10 (FIGS. 20 and 21).

Referring to FIGS. 22 to 30, compared with the second embodiment, in a fifth embodiment of the present disclosure, secondary expansion cone 50 is further provided between the primary expansion cone 20 and the central tube 10. The secondary expansion cone 50 is provided with a third tapered through-hole, and the third tapered through-hole has a large end sleeved at the small end of the central tube 10.

The secondary expansion cone 50 is a radially expandable structure, and the secondary expansion cone 50 supports the primary expansion cone 20 after an expansion.

The large end of the primary expansion cone 20 is provided with first anti-pre-expansion section 21. The first initial expansion force of the first anti-pre-expansion section 21 is greater than the initial expansion force of the anchor 30. The secondary expansion cone 50 includes a plurality of secondary expansion plates that are circumferentially arranged and radially expandable. The plurality of secondary expansion plates are extended axially and arranged in parallel. A second anti-pre-expansion hoop is sleeved on the secondary expansion plates at the large end of the secondary expansion cone 50 to form the second anti-pre-expansion section 51. A second initial expansion force of the second anti-pre-expansion section 51 is greater than the first initial expansion force of the first anti-pre-expansion section 21. When the second anti-pre-expansion section 51 undergoes radial expansion and plastic deformation, the second initial expansion force is equivalent to the minimum axial thrust exerted by the operating tool on the central tube.

Figure 25:
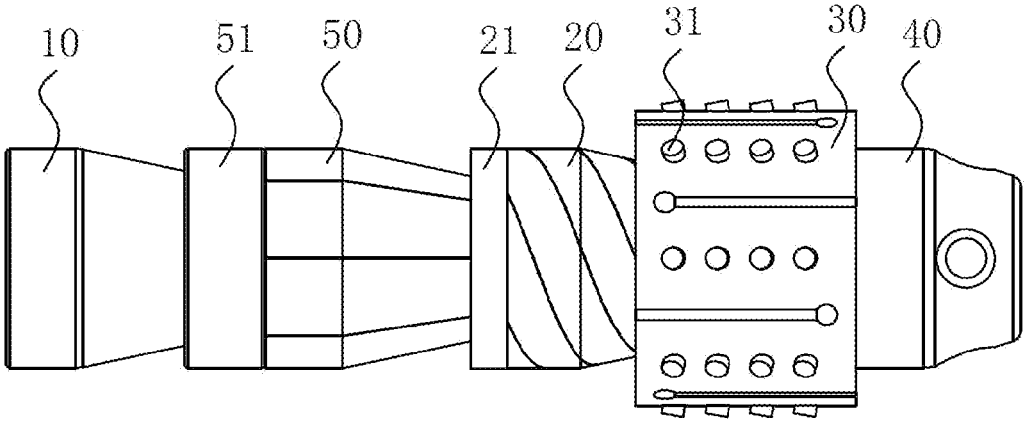
FIG. 25 is a unidirectional view of the downhole packer in a first state according to the fifth embodiment.
Figure 26:
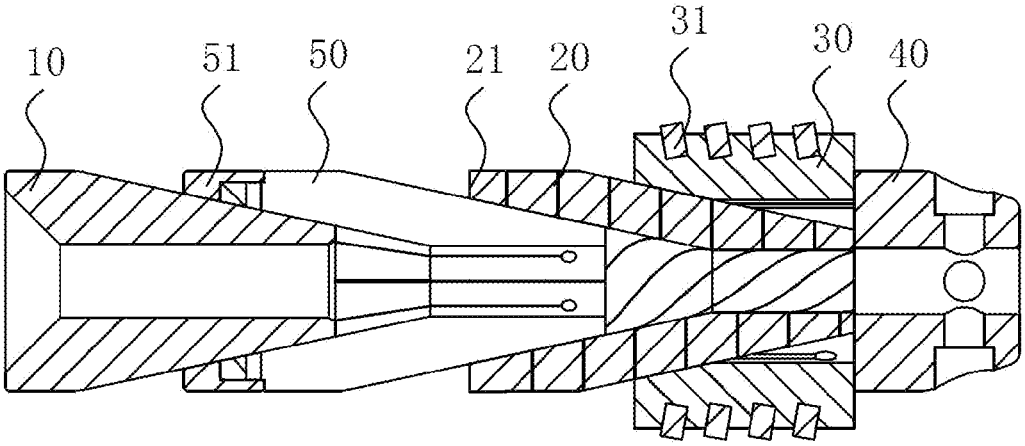
FIG. 26 is a unidirectional section view of the downhole packer shown in FIG. 25.

The working principle is as follows. One end of the operating tool is fixedly connected to the inner hole of the lower sub 40, and the other end of the operating tool is butted with the central tube 10. When the operating tool is in operation, one end of the operating tool drives the lower sub 40 to exert a thrust on the slip, and the other end of the operating tool exerts a thrust on the central tube 10, such that the central tube 10 drives the secondary expansion cone 50 and the primary expansion cone 20 to move into the slip. When the radial extrusion force exerted by the primary expansion cone 20 on the slip is greater than the initial expansion force of the slip, the slip is radially expanded until the primary expansion cone 20 is butted with the lower sub 40, thus achieving a first radial expansion of the slip (FIGS. 25 and 26). Since the first initial expansion force of the first anti-pre-expansion section 21 is greater than the initial expansion force of the slip and the radial extrusion force exerted by the central tube 10 on the primary expansion cone 20 is less than the first initial expansion force, the primary expansion cone 20 is not expanded. In addition, since the second initial expansion force of the second anti-pre-expansion section 51 is greater than the first initial expansion force of the first anti-pre-expansion section 21, the secondary expansion cone 50 is not expanded.

Figure 27:
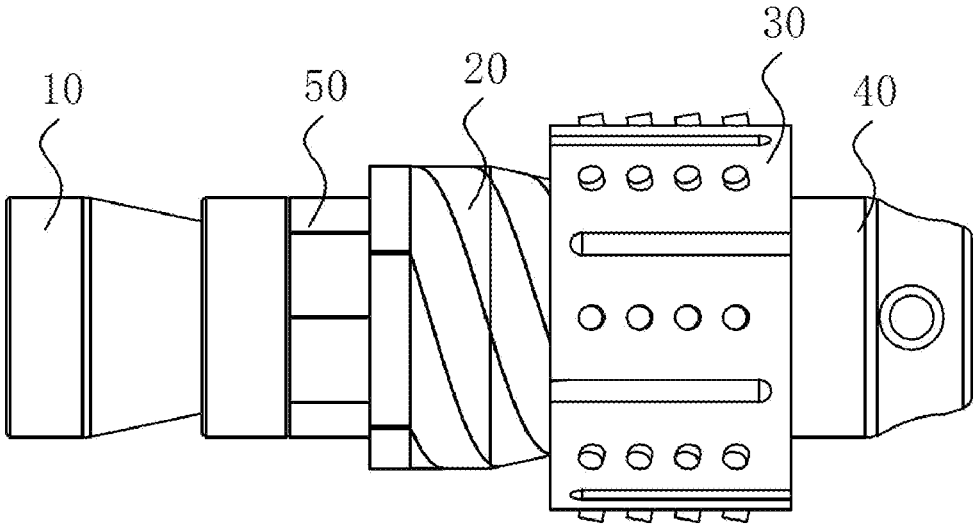
FIG. 27 is a unidirectional view of the downhole packer in a second state according to the fifth embodiment.
Figure 28:
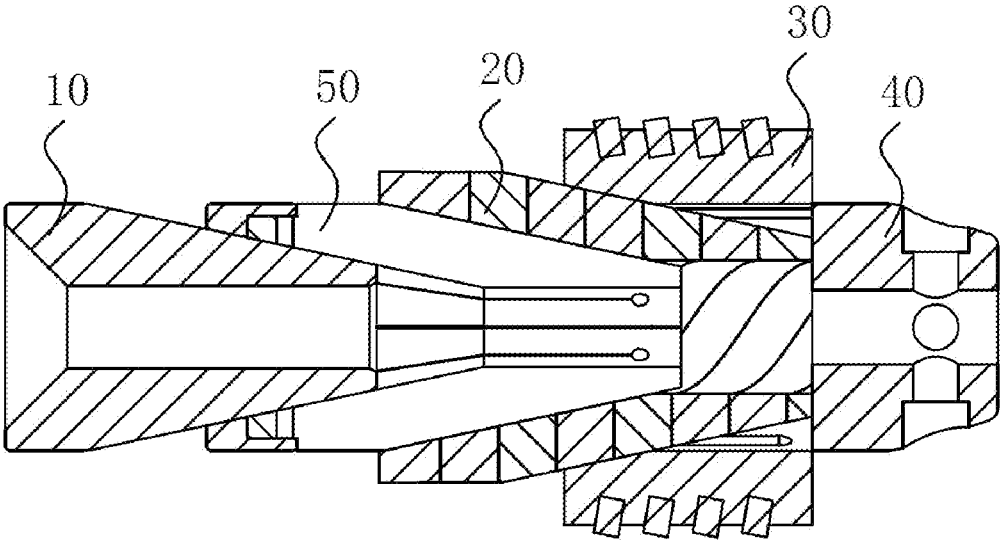
FIG. 28 is a unidirectional section view of the downhole packer shown in FIG. 27.

The operating tool continues to drive the central tube 10 and the secondary expansion cone 50 to move into the primary expansion cone 20. When the radial extrusion force exerted by the secondary expansion cone 50 on the primary expansion cone 20 is greater than the first initial expansion force, the first anti-pre-expansion section 21 is broken or expanded. Thus, the primary expansion cone 20 is radially expanded until the secondary expansion cone 50 is butted with the lower sub 40, thus achieving a second radial expansion of the slip (FIGS. 27 and 28).

Figure 29:
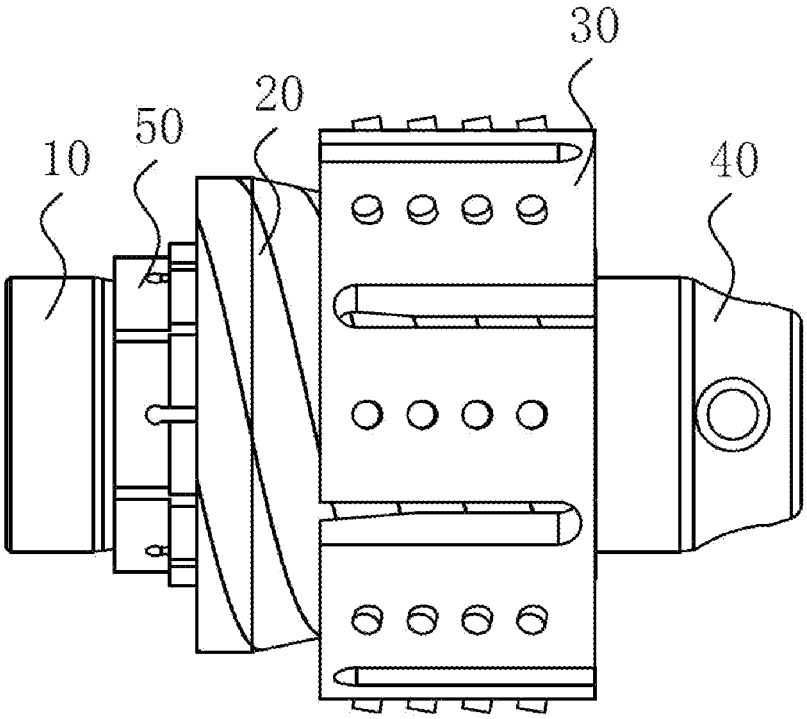
FIG. 29 is a unidirectional view of the downhole packer in a third state according to the fifth embodiment of the present disclosure.
Figure 30:
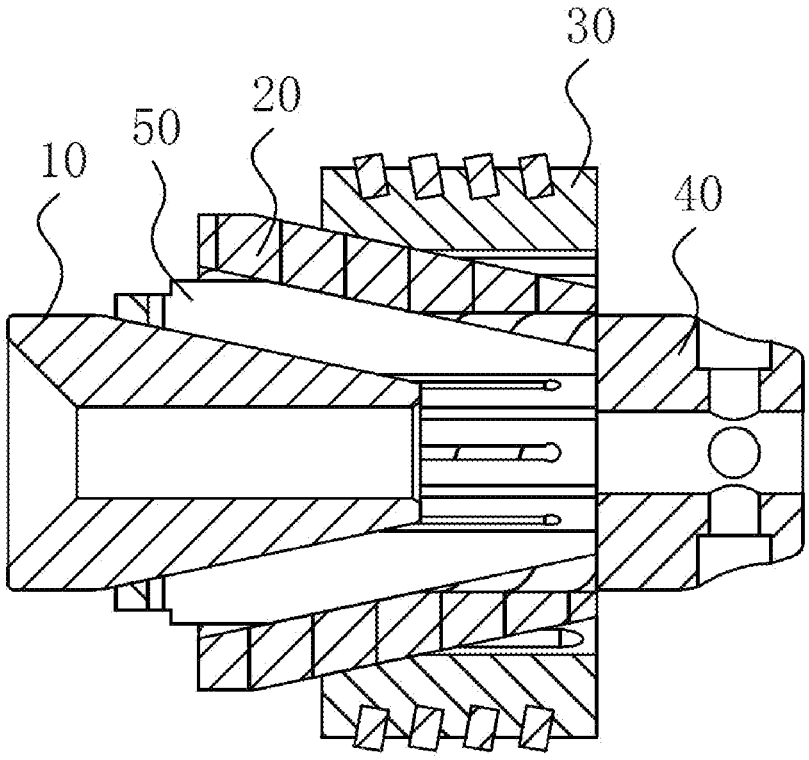
FIG. 30 is a unidirectional section view of the downhole packer shown in FIG. 29.
Figure 31:
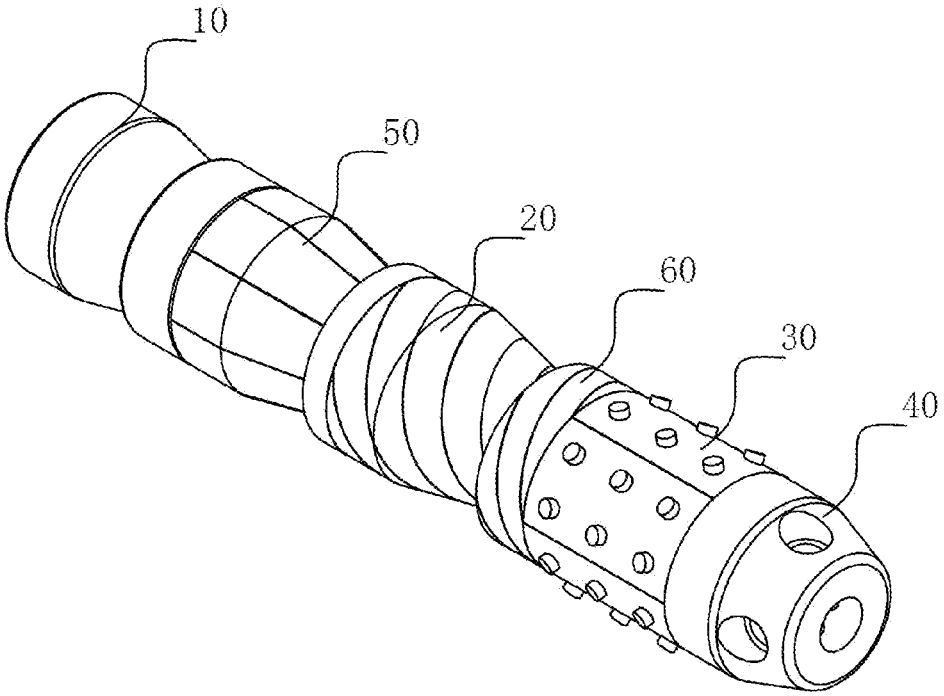
FIG. 31 is a stereoscopic view of a downhole packer according to a sixth embodiment of the present disclosure.
Figure 32:
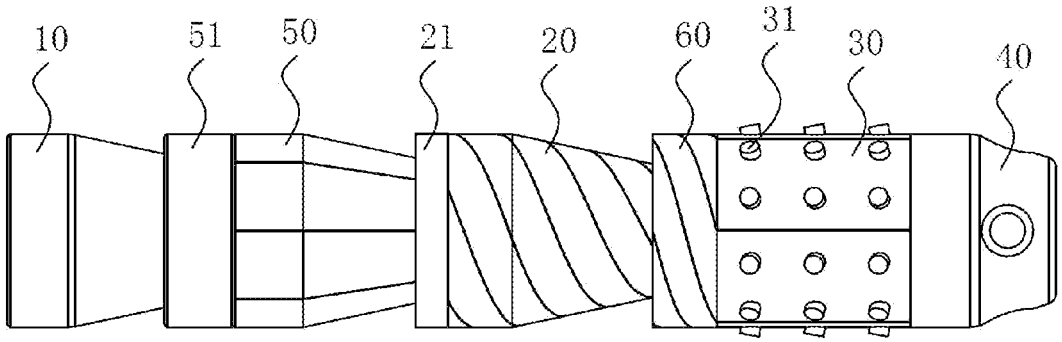
FIG. 32 is a unidirectional view of the downhole packer according to the sixth embodiment of the present disclosure.
Figure 33:
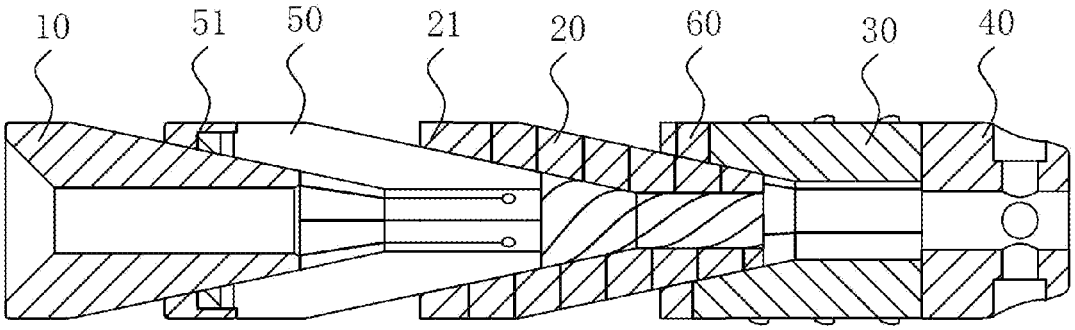
FIG. 33 is a unidirectional section view of the downhole packer shown in FIG. 32.
Figure 34:
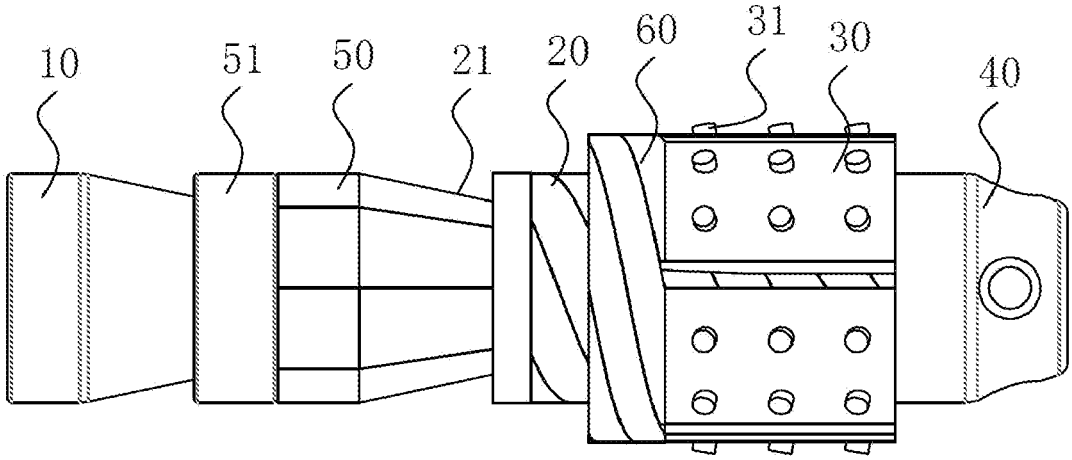
FIG. 34 is a unidirectional view of the downhole packer in a first state according to the sixth embodiment.
Figure 35:
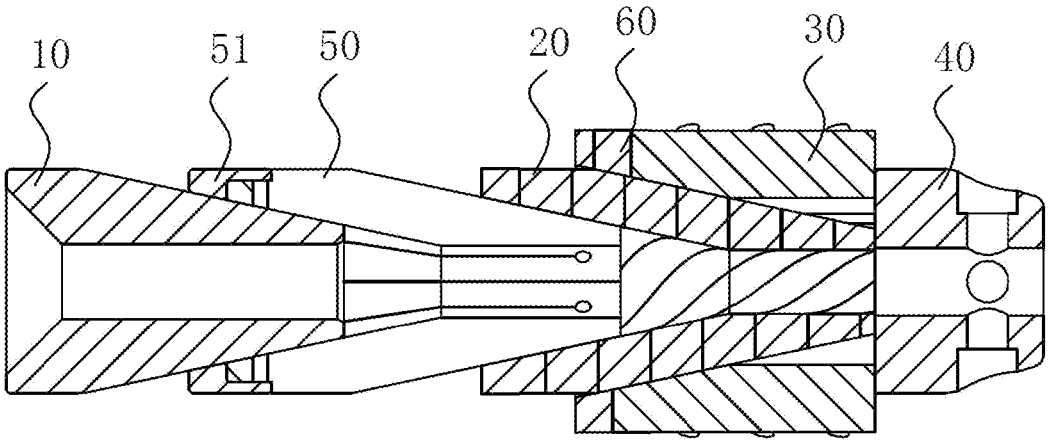
FIG. 35 is a unidirectional section view of the downhole packer shown in FIG. 34.
Figure 36:
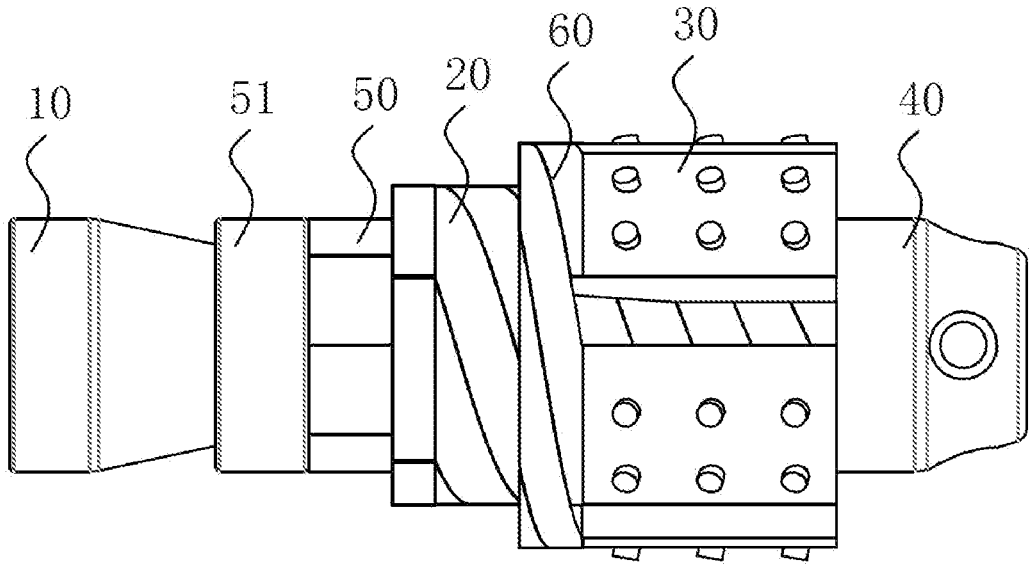
FIG. 36 is a unidirectional view of the downhole packer in a second state according to the sixth embodiment.
Figure 37:
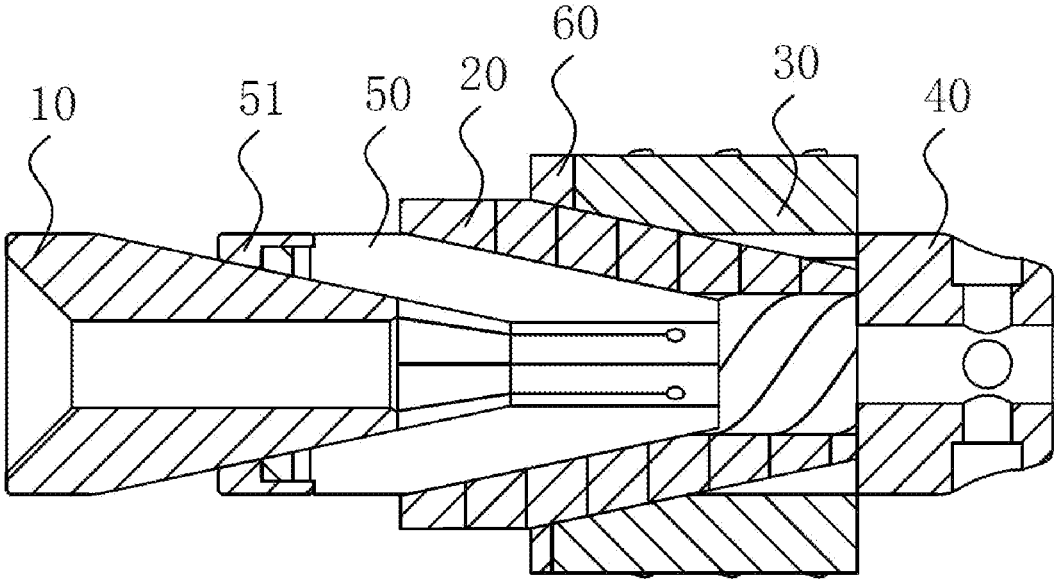
FIG. 37 is a unidirectional section view of the downhole packer shown in FIG. 36.
Figure 38:
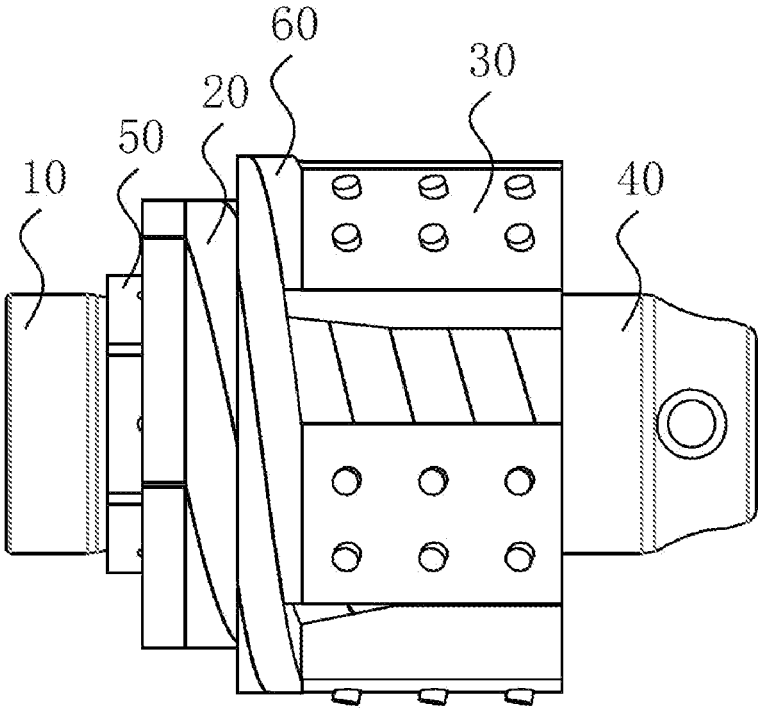
FIG. 38 is a unidirectional view of the downhole packer in a third state according to the sixth embodiment of the present disclosure.
Figure 39:
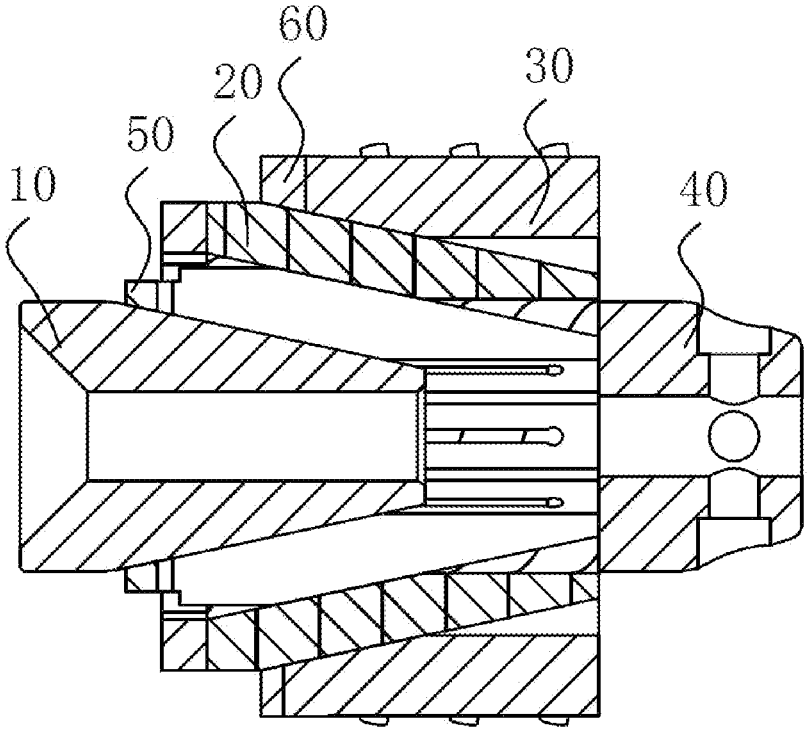
FIG. 39 is a unidirectional section view of the downhole packer shown in FIG. 38.

The operating tool continues to drive the central tube 10 into the primary expansion cone 20. When the radial extrusion force exerted by the central tube 10 on the secondary expansion cone 50 is greater than the second initial expansion force, the second anti-pre-expansion hoop of the second anti-pre-expansion section 51 is broken or expanded. Thus, the secondary expansion cone 50 is radially expanded until the slip anchors with the inner wall of the wellbore. In this way, a third radial expansion of the slip is achieved through the central tube 10 (FIGS. 29 and 30).

In this embodiment, after three expansions, the slip of the downhole packer can achieve an expansion ratio of more than 120%, far exceeding the expansion ratio, namely, 10% to 30%, of the existing packer. In addition, through the expansions of the secondary expansion cone 50 and the primary expansion cone 20 and the extrusion of the central tube 10, the slip achieves the sealing function with the inner wall of the wellbore.

Referring to FIGS. 31 to 39, compared with the fifth embodiment, in a sixth embodiment of the present disclosure, the downhole packer further includes sealing element 60. The sealing element 60 is radially expandable to create a seal with the inner wall of the wellbore. The sealing element 60 is located at the large end of the first tapered through-hole and sleeved at the small end of the primary expansion cone 20. The primary expansion cone 20 supports the sealing element 60 after an expansion. Specifically, the sealing element 60 and the anchor 30 form an integrated structure. The anchor 30 is a split slip formed by a plurality of toothed plates arranged circumferentially. The split slip and the sealing element 60 are connected into an integrated structure. In this embodiment, the sealing element 60 is a spiral sealing element 60. The spiral sealing element 60 has a high radial expansion ratio, which ensures the ultra-high expansion ratio of the packer.

The working principle of this embodiment is the same as that of the fifth embodiment. That is, the first radial expansion (FIGS. 34 and 35), the second radial expansion (FIGS. 36 and 37), and the third radial expansion (FIGS. 38 and 39) of the slip and the sealing element 60 as a whole are achieved through the operating tool. The design further improves the sealing effect of the packer.

In a specific embodiment, the primary spiral expansion section of the primary expansion cone 20 may have only a partial length, that is, a one-segment length, in an axial direction of the primary expansion cone, as long as the primary spiral expansion section can maintain the spirally spliced structure after a radial expansion. When the primary expansion cone 20 enters the anchor, the spirally spliced structure supports the anchor 30 circumferentially.

Similarly, the secondary spiral expansion section of the secondary expansion cone 50 may have only a partial length, that is, a one-segment length, in an axial direction of the secondary expansion cone, as long as the secondary spiral expansion section can maintain the spirally spliced structure after a radial expansion. When the secondary expansion cone 50 enters the primary expansion cone 20, the spirally spliced structure supports the primary expansion cone 20 circumferentially.

In a specific embodiment, the sealing element 60 may be a sealing ring sleeved in a circumferential direction of the anchor 30, such as a sealing sleeve. A groove is provided on the outer circumference of the anchor 30, and the sealing sleeve is sleeved in the recess. The sealing element 60 may undergo a second expansion with the expansion of the anchor 30.

The above described are merely preferred embodiments of the present disclosure, which are not intended to limit the present disclosure. Any modifications, equivalent replacements, and improvements made within the spirit and principle of the present disclosure should be included in the protection scope of the present disclosure.

What is claimed is:

1. An ultra-high expansion downhole packer, comprising an anchor, a primary expansion cone, and a central tube, wherein the anchor is provided with a first tapered through-hole, and the first tapered through-hole has a large end sleeved at a small end of the primary expansion cone;

and the anchor is radially expandable to anchor with an inner wall of a wellbore; and the primary expansion cone is provided with a second tapered through-hole, and the second tapered through-hole has a large end sleeved at a small end of the central tube; and the primary expansion cone is a radially expandable structure, and the primary expansion cone supports the anchor after an expansion, wherein the large end of the primary expansion cone is provided with a first anti-pre-expansion section, and the first anti-pre-expansion section has a first initial expansion force greater than an initial expansion force of the anchor.

2. The ultra-high expansion downhole packer according to claim 1, wherein the primary expansion cone comprises a plurality of primary expansion plates, wherein the plurality of primary expansion plates are circumferentially arranged and radially expandable; and the plurality of primary expansion plates form an integrated structure at the large end of the primary expansion cone to form the first anti-pre-expansion section.

3. The ultra-high expansion downhole packer according to claim 1, wherein the primary expansion cone comprises a plurality of primary expansion plates, wherein the plurality of primary expansion plates are circumferentially arranged and radially expandable; and a first anti-pre-expansion hoop is sleeved on the plurality of primary expansion plates at the large end of the primary expansion cone to form the first anti-pre-expansion section.

4. The ultra-high expansion downhole packer according to claim 1, further comprising a sealing element, wherein the sealing element is radially expandable to create a seal with the inner wall of the wellbore; the sealing element is located at the large end of the first tapered through-hole and sleeved at the small end of the primary expansion cone; and the primary expansion cone supports the sealing element after the expansion.

5. The ultra-high expansion downhole packer according to claim 4, wherein the sealing element and the anchor form an integrated structure.

6. The ultra-high expansion downhole packer according to claim 1, further comprising a sealing element, wherein the sealing element is radially expandable to create a seal with the inner wall of the wellbore; and the sealing element is a sealing ring sleeved in a circumferential direction of the anchor.

7. The ultra-high expansion downhole packer according to claim 1, wherein the primary expansion cone comprises a plurality of primary expansion plates, wherein the plurality of primary expansion plates are circumferentially arranged and radially expandable; the primary expansion cone has a primary spiral expansion section of a certain length; and the primary spiral expansion section is formed by spiral splicing of the plurality of primary expansion plates and maintains a spirally spliced structure after a radial expansion.

8. The ultra-high expansion downhole packer according to claim 7, wherein after the primary expansion cone is driven into the anchor, the primary spiral expansion section is radially expanded to support at least part of the anchor.

9. The ultra-high expansion downhole packer according to claim 1, wherein the anchor comprises a plurality of toothed plates arranged circumferentially; the primary expansion cone comprises a plurality of primary expansion plates, wherein the plurality of primary expansion plates are circumferentially arranged and radially expandable; the plurality of primary expansion plates are in one-to-one correspondence to the plurality of toothed plates; and a primary limiting structure is provided between an outer surface of each of the plurality of primary expansion plates and an inner surface of each of the plurality of toothed plates to prevent relative circumferential movement between each of the plurality of primary expansion plates and each of the plurality of toothed plates.

10. The ultra-high expansion downhole packer according to claim 9, wherein the primary limiting structure is a first nested limiting structure provided between the outer surface of each of the plurality of primary expansion plates and the inner surface of each of the plurality of toothed plates.

11. The ultra-high expansion downhole packer according to claim 1, wherein an end of the anchor is butted with a lower sub, wherein the end of the anchor opposes the large end.

12. The ultra-high expansion downhole packer according to claim 1, wherein a secondary expansion cone is provided between the primary expansion cone and the central tube; the secondary expansion cone is provided with a third tapered through-hole, and the third tapered through-hole has a large end sleeved at the small end of the central tube; and the secondary expansion cone is a radially expandable structure, and the secondary expansion cone supports the primary expansion cone after the expansion.

13. The ultra-high expansion downhole packer according to claim 12, wherein the large end of the secondary expansion cone is provided with a second anti-pre-expansion section, and the second anti-pre-expansion section has a second initial expansion force greater than the first initial expansion force of the first anti-pre-expansion section.

14. The ultra-high expansion downhole packer according to claim 13, wherein the secondary expansion cone comprises a plurality of secondary expansion plates, wherein the plurality of secondary expansion plates are radially expandable; and the plurality of secondary expansion plates form an integrated structure at the large end of the secondary expansion cone to form the second anti-pre-expansion section.

15. The ultra-high expansion downhole packer according to claim 13, wherein the secondary expansion cone comprises a plurality of secondary expansion plates, wherein the plurality of secondary expansion plates are radially expandable; and a second anti-pre-expansion hoop is sleeved on the plurality of secondary expansion plates at the large end of the secondary expansion cone to form the second anti-pre-expansion section.

16. The ultra-high expansion downhole packer according to claim 12, wherein the secondary expansion cone comprises a plurality of secondary expansion plates, wherein the plurality of secondary expansion plates are circumferentially arranged and radially expandable; the secondary expansion cone has a secondary spiral expansion section of a certain length; and the secondary spiral expansion section is formed by spiral splicing of the plurality of secondary expansion plates, and maintains a spirally spliced structure after a radial expansion.

17. The ultra-high expansion downhole packer according to claim 16, wherein after the secondary expansion cone is driven into the primary expansion cone, the secondary spiral expansion section is radially expanded to support at least part of the primary expansion cone.

18. The ultra-high expansion downhole packer according to claim 12, wherein the primary expansion cone comprises a plurality of primary expansion plates, wherein the plurality of primary expansion plates are circumferentially arranged and radially expandable; the secondary expansion cone comprises a plurality of secondary expansion plates, wherein the plurality of secondary expansion plates are circumferentially arranged and radially expandable; the plurality of primary expansion plates are in one-to-one correspondence to the plurality of secondary expansion plates; and a secondary limiting structure is provided between an outer surface of each of the plurality of secondary expansion plates and an inner surface of each of the plurality of primary expansion plates to prevent relative circumferential movement between each of the plurality of secondary expansion plates and each of the plurality of primary expansion plates.

19. The ultra-high expansion downhole packer according to claim 18, wherein the secondary limiting structure is a second nested limiting structure provided between the outer surface of each of the plurality of secondary expansion plates and the inner surface of each of the plurality of primary expansion plates.

* * * * *